US006067764A

United States Patent [19]

Johansen

[11] Patent Number: 6,067,764

[45] Date of Patent: May 30, 2000

[54] INSULATION ASSEMBLY INCLUDING A SPACING ELEMENT

[76] Inventor: Knud Erik Johansen, Dragsbaekvej 80, DK-7700 Thisted, Denmark

[21] Appl. No.: 09/029,356

[22] PCT Filed: Aug. 27, 1996

[86] PCT No.: PCT/DK96/00357

§ 371 Date: Feb. 24, 1998

§ 102(e) Date: Feb. 24, 1998

[87] PCT Pub. No.: WO97/08404

PCT Pub. Date: Mar. 6, 1997

[30] Foreign Application Priority Data

Aug. 28, 1995 [DK] Denmark ..... 9500326

[51] Int. Cl.[7] ..... E04B 2/30

[52] U.S. Cl. ..... 52/302.1; 52/508; 52/783.18; 52/645; 52/407.1

[58] Field of Search ..... 52/783.17, 783.18, 52/730.1, 645, 690, 696, 302.1, 508, 407.1, 794.1

[56] References Cited

U.S. PATENT DOCUMENTS

| | | | |
|---|---|---|---|
| 2,101,836 | 12/1937 | Benedict | 52/783.17 X |
| 2,786,004 | 3/1957 | Schwartz et al. | 52/783.17 X |
| 3,112,532 | 12/1963 | Slowinski | 52/783.17 |
| 4,546,591 | 10/1985 | Beltz | 52/645 |

FOREIGN PATENT DOCUMENTS

| | | | |
|---|---|---|---|
| 2353927 | 5/1975 | Germany . | |
| 62696 | 7/1940 | Norway . | |
| 442529 | 1/1986 | Sweden . | |
| 1822898 | 6/1993 | U.S.S.R. | 52/783.17 |
| 757418 | 9/1956 | United Kingdom . | |

*Primary Examiner*—Robert Canfield
*Attorney, Agent, or Firm*—Antonelli, Terry, Stout & Kraus, LLP

[57] ABSTRACT

The invention is an assembly for providing insulation. An assembly which provides ventilation in accordance with the invention includes a planar element; insulation positioned proximate to the planar element; and at least one space element, each space element being positioned between the planar element and the insulation, the space element including two parallel straight plate members and at least one distance member which interconnects the two parallel straight plate members which respectively face the planar element and the insulation, each distance member including two spaced apart bendable sections attached to zones of attachment to the plate members and a displacement part connected to the bendable sections and defining an angle (α) with one plate member with the angle (α) being variable by parallel displacement of the plate members away from or towards each other and defining a separation which is fixable between the parallel straight plate members with a fixed separation defining a ventilation space between the planar element and the insulation.

14 Claims, 4 Drawing Sheets

INSULATION ASSEMBLY INCLUDING A SPACING ELEMENT

BACKGROUND OF THE INVENTION

1. Field of the Invention

The present invention relates to a space element having a honeycomb structure.

Space elements are a universally usable constructive element as it can be used wherever reinforcement or support is required; by way of example in connection with furniture structures of different types, but especially within building construction to provide ventilation cavities or passages under roofs, floors and in similar places, especially in insulated cavity wall structures.

2. Description of the Prior Art

Considering the high degree of focus at present to indoor climate problems it is important that adequate ventilation should be ensured in building constructions. To this end, various building regulations prescribe certain minimum values which are, however, not observed very often as it is difficult to obtain with the prior art. This is because known space elements and honeycomb structures of this type are only found in given fixed dimensions and thicknesses. In cases where, due to mounting and space is required that a space element may be expanded after placement in permanent position, for instance between two building parts, there are no practical usable solutions known today.

DE-A-2 353 927 discloses a partition wall and shuttering plate element consisting of two plate members made from waterproof corrugated cardboard and being mutually interconnected by Z-, U-, H- or tubeshaped collapsible connections parts which are secured by glue to the respective plate members.

GB-A-757 418 discloses a prefabricated building panel comprising a pair of facing sheets of hard-board or plasterboard between which there is sandwiched a corrugated sheet of cardboard or fibre board. The corrugations of the sheet are flat topped and include connecting web portions which—in the extended or open position of the panel—extend at right angles to the facing sheets and are of a length such as to give the required spacing of the sheets. The flat topped portions of the corrugations are secured by means of a suiteable cement alternately to the facing sheets, and the corrugated sheet is weakened adjacent the ends of the web portions to provide a hinge connection with the corresponding facing sheet thereby to permit the corrugations to fold to a close or collapsed position in which position the folded corrugated sheet is tightly sandwiched between the facing sheets. In order to secure the facing sheets in an open, or extended position, strips of a riged sheet material are inserted lengthwise in selected of the corrugations. The width of the strip being such that the strip extends diagonally across the corrugations to engage diagonally opposite corners thereof and thereby brace the corrugated sheets in the open or extended position and prevent folding of the sheet. Alternatively a wooden spacer post of similar cross section to that of a corrugation and adapted to fit snugly therein is inserted lengtwise in selected of the corrugations.

SE-A-442 529 discloses a buiding element for the construction of walls, floor, roof or similar construction part and comprising an outer wall at two opposite sides and at least two distance members which are provided—at the use of the building element—to keep said outer walls in a predetermined distance from each other. The distance members consist of relative thin strips of bendable, plastic deformable material, as the distance member is connected to both outer walls and provided to be bent between a use position where the outer walls are kept in a predetermined distance from each other and a transport position where the outer walls are positioned close to each other.

SUMMARY OF THE INVENTION

The main purpose of the present invention is to provide a space element which may be distributed and mounted in the compact (collapsed) form, and which in an easy and uncomplicated manner may be expanded, that is become thicker, after it has been placed in permanent position. In addition, it should preferably be possible to anchor or lock the space element in the expanded form without any major technical provisions.

According to the invention the main purpose is achieved by two plate members displaced parallel towards each other or away from each other by subjecting pull or pressure to the free ends of the plate members, whereby an angle $\alpha$ is changed. In this manner the distance members cause the expansive effect aimed at when the two longitudinal narrow plate members are displaced relative to each other. The displacement may, of course, be carried out without the use of tools, that is just by affecting the free ends of the plate members by pulling and pressing, respectively. In other words: The degree of expansion or thickness of the space element may be changed by displacing the two plate members relative to each other. In expanded condition the space element has a honeycomb-like structure which imparts high strength and rigidity to the space element compared to weight and quantity of material. Completely collapsed, that is with the distance members folded closely against the plate members, the space element according to the invention has a minimum thickness. Therefore it may be mounted even in places with difficult access, for instance between the outer wall and the insulation in a completed cavity wall structure. After insertion in permanent position in the cavity wall which for instance may be done by insertion between the building elements from above, the space element is then expanded by exerting a pull/pressure at the plate members until the required expansion has been achieved. Now a suitable ventilation cavity is provided between the outer wall and the insulation, thus permitting air circulation and a useful venting and drying of the insulated cavity wall structure.

The statement that the profiles are parallel and straight means that they are mainly parallel and straight. The space element comprises two such narrow plate members, but may well consist of more than two, for instance three. The plate members preferably are rigid, as opposed to the distance members which are flexible.

More space elements of this type may be combined, for instance next to each other, resulting in a so-called multiple space element with more than two plate members and a number of rows of distance members which equals the number of plate members minus one. They also form a honeycomb-like structure with the well-known advantages of this structure. The degree of expansion of such a multiple element is increased relative to the simple element with only two plate members.

The connection zone for a distance member may have any shape, and the attachment may be carried out in any way which is obvious to the skilled man, for instance by gluing, soldering or welding, or by nailing, screwing, riveting or stapling. All depending on the materials chosen and the strength required.

The variability of the angle α through parallel displacement of the plate members away from or towards each other may for instance be obtained by the use of distance members which themselves are flexible, either by virtue of a material flexible in itself or by virtue of a special design with for instance areas of reduced thickness.

Preferably, the distance members comprise pre-fabricated deformation or bending zones at the very connecting points with the plate members or in the close proximity of the points. The bending zones may for instance be produced by pre-bending of the distance member material or by stamping, and thus having the effect that the angle of the ribs may be changed relative to the profiles by parallel displacement of the two plate members relative to each other as the distance members are deformed by bending in the bending zones. During this process those parts of the distance members which are between the bending zones remain unchanged in all essentials, that is straight or only slightly curved.

For reasons of economy uniformed distance member sections are mainly used. However, the distance member sections do not need to be identical, they just have to "work together" in the right manner during parallel displacement of the plate members. When thus each distance member section is connected to one plate member in one connection zone (one end) and to the other plate member in the other connection zone (the other end), all distance member sections of this preferred embodiment will run parallel and at the same variable angle α relative to the plate members.

Preferably, the distance member sections are placed with the same mutual distance. A reliable, smooth displacement movement is thereby obtained. But a constant distance is not required to obtain the expansion effect.

A space list comprising a space element according to the invention may advantageously be arranged for locking in an expanded position, as the two plate members being fixable relative to each other at least at one end of the space list. Such fixing may be performed in any manner, most expediently by stapling or gluing.

In a preferred embodiment the distance members (or at least sections of these) are made of one continuous length of material which is bent and folded to a shape with displacement areas in the form of distance member parts, and attachment areas in the form of feet parts in continuation of each other and creating directly the distance member shape required after being suitably glued in between the two plate members. The result is a very simple manufacture of space elements.

In the following the invention is described in more detail reference being made to the accompanying drawing which shows some preferred embodiments of the space element according to the invention.

DESCRIPTION OF THE PREFERRED EMBODIMENT

Figure 1:
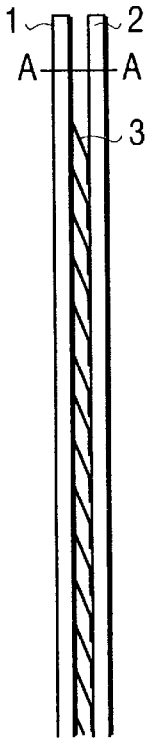
FIG. 1 shows a side view of a space element according to the invention, shown in collapsed condition.
Figure 3:
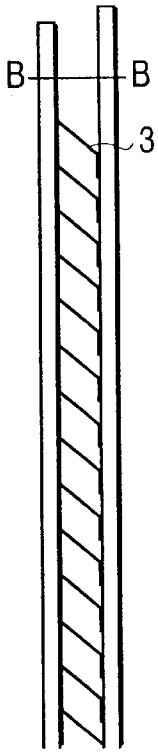
FIG. 3 is the same space element as in FIG. 1, but now shown in expanded condition.
Figure 2:
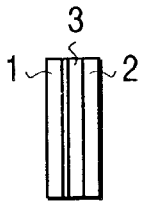
FIG. 2 is a sectional view of the same along line A—A in FIG. 1.
Figure 4:
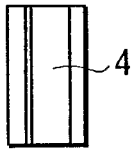
FIG. 4 is a sectional view along line B—B in FIG. 3.
Figure 5:
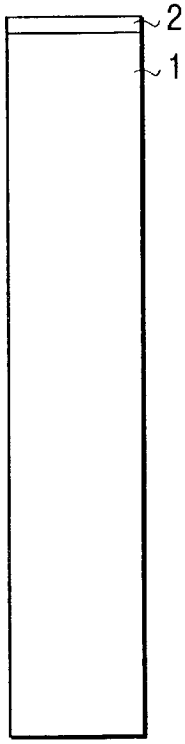
FIG. 5 is a front view of the space element in FIG. 3.
Figure 3A:
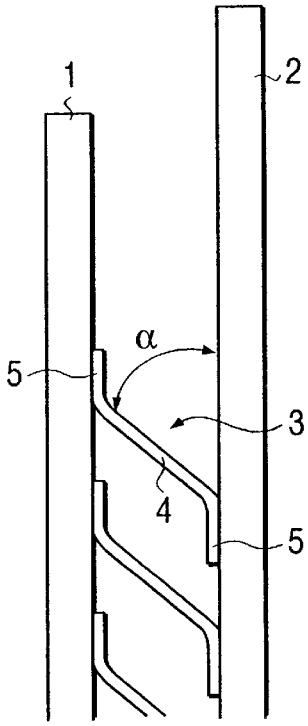
FIG. 3*a* is an enlarged section of the space element in FIG. 3.

FIGS. 1–5 of the drawing show an embodiment of a space element according to the invention. The space element shown consists of two straight plate members 1 and 2 placed parallel to each other, and a number of distance members 3 glued in between these plate members. Plate members 1 and 2 may for instance be made from synthetic material like plastics by extrusion or die casting from metal or wood; the distance members 3 from stiff paper or cardboard, synthetic material like plastic, if desired in the form of laminated plastic. The choice of material may of course be adapted to the planned use. Thermoplastic may be used for plate members and distance members; thermosetting plastic, possibly reinforced, may also be used for the plate members. Among usable types of plastic may be mentioned: Polyethylene, polypropylene, polyvinyl chloride, polystyrene, acrylic plastic, ABS-plastic, polyamide and polycarbonate (all thermoplastics) as well as phenolformaldehyde, carbamid-formaldehyde, melamine-formaldehyde (thermosetting plastics). The list is not exhaustive.

In the embodiment shown, the distance members 3 are all identical and placed at the same (variable) angle α relative to the plate members. Each of the distance members shown has a displacement part 4 in the form of a substantially straight central section having at each end a flap which constitutes the connection zones 5 and for the attachment of the distance member by gluing to the respective plate member 1 or 2. By displacement of the two plate members relative to each other the distance member angle α changes and thus the distance between the plate members. This property is used to render the space element expansive so that it can be mounted in the compact form (see FIG. 1), and only after being placed in the permanent position the space element is expanded to the thickness required in the place concerned. If necessary, the expansion may be carried out without the use of tools. In the embodiment shown the variation of angle α is planned to be between 0 and 90°, but the said angle may also be larger than 90°, perhaps close to 180°, if desirable.

Figure 6:
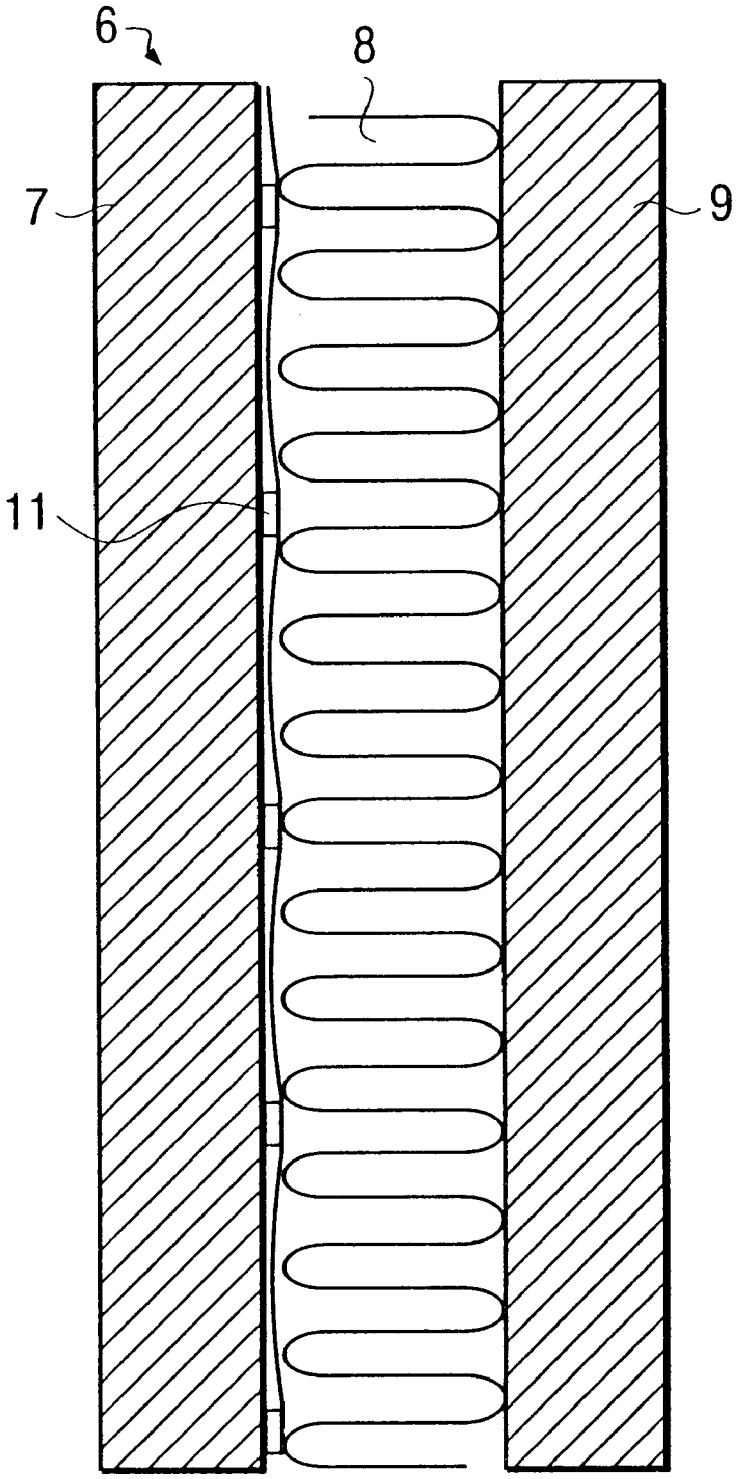
FIG. 6 is a horizontal sectional view of an insulated cavity wall structure with inserted (expanded) ventilatory space elements.
Figure 7:
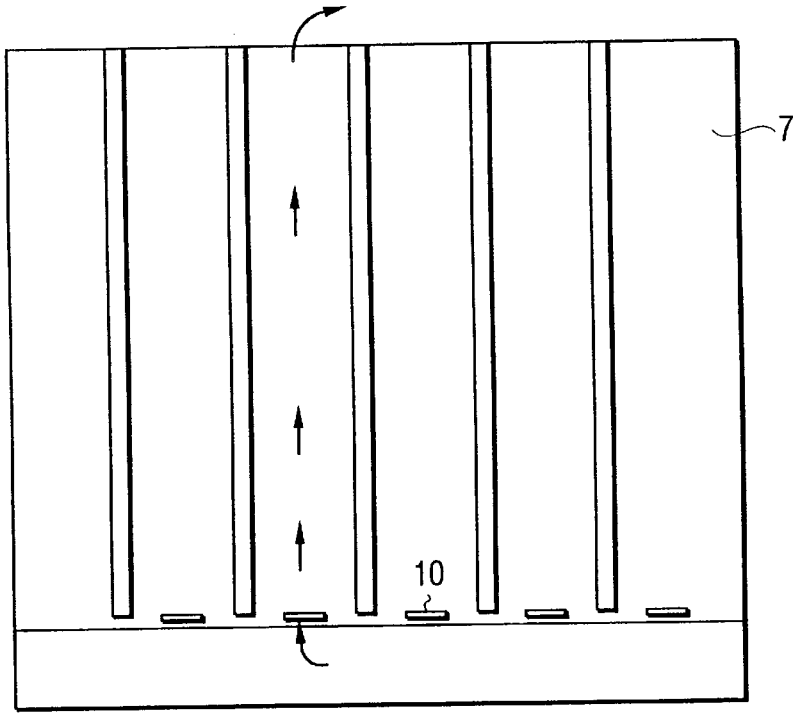
FIG. 7 is a front view of the same cavity wall structure.
Figure 8:
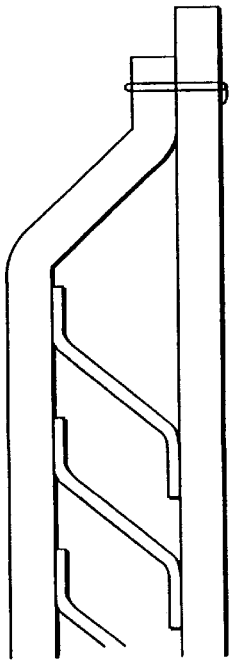
FIG. 8 is a sectional view showing the interlocking of the two plate members by stapling after expansion of the space element.
Figure 9:
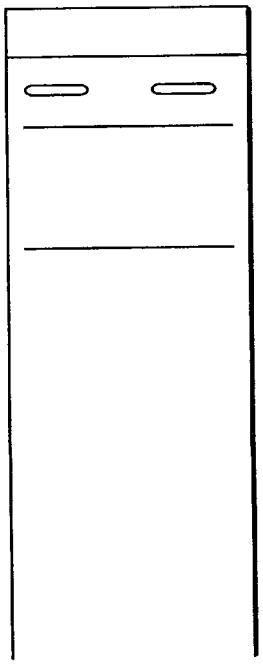
FIG. 9 is a front view of the space element with interlocked plate members in FIG. 8.

FIGS. 6, 7 and 8 show an example of a space element according to the invention used as a ventilatory element in a cavity wall 6 consisting of outer wall 7, insulating bats 8 and rear wall 9. After building of the wall to full height the space elements are pushed vertically down between the outer wall 7 and the insulation 8. This is possible because of the small thickness of the space element before the expansion. The expansion is carried out when the space element is in position in the wall by exerting a manual pressure/pull at the plate members 1, 2 at the end thereof, which project above the cavity wall. After the expansion the plate members are interlocked, for instance by stapling the two plate members to each other as shown in FIGS. 8 and 9, whereby the expanded position is frozen. A number of vertical spacers have now been established between the outer wall and the insulation which—in connection with the normal ventilation openings 10 of the wall—secure a desired air circulation and drying inside the insulated cavity wall itself.

Figure 10:
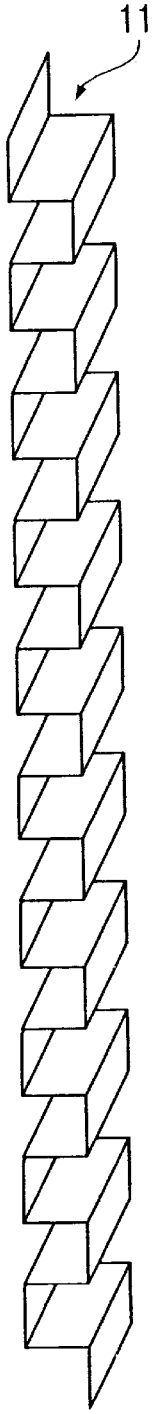
FIG. 10 is a preferred embodiment with a continuous distance member section folded from one continuous length of material.
Figure 11:
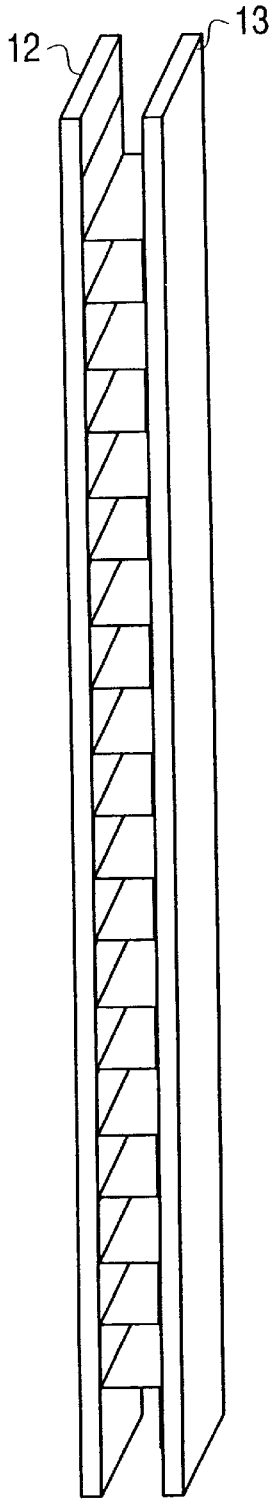
FIG. 11 is the distance member section shown in FIG. 10 glued in between the two strip plate members and with the space element in the expanded condition.
Figure 12:
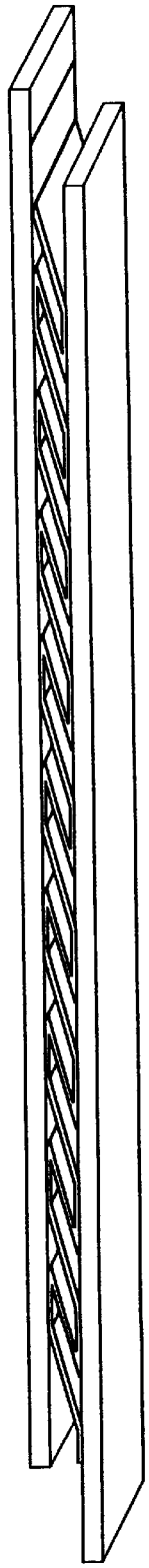
FIG. 12 is the same as in FIG. 11, but in partly collapsed condition.

FIGS. 10, 11 and 12 show continuous sections of distance members made by folding one continuous length of material 11 and glued in between two strip plate members 12 and 13. The embodiment distinguishes itself by being very simple from a construction point of view and is at the same time suitable for being prepared by an industrialised process whereby the manufacturing costs may be kept at a reasonably low level.

A suitable material for the distance members in the space element according to the invention is stiff paper, cardboard, plastic foil, metal foil or a laminate of two or more such materials. Preferably, each distance member has a flap at each end which is glued or thermo welded to the plate member concerned.

A suitable material for the plate members is bending resistant materials, for instance extruded or die cast plastic, metal or wood of a suitable flat-profile design. Preferably, the flat sides of the plate members are facing each other with the distance members fixed inbetween.

Preferably, the space element according to the invention is distributed in long "endless" lengths, that is intended for being shortened to the length required at the very location of use, that is for mounting. Moreover, dimensions and choice of material are adapted to the field of use which within the field of construction, besides the cavity walls, may be: Insulation slots under floors, air-sound insulation under wooden floors at floor decks, bearer batten under laminated floors, stretching of underroof (the element may be placed both on top of and under the underroof), ventilation slots under flat roof structures, ceilings, etc. In furniture structure the following fields of use may be mentioned where it is especially used for collapsible furniture: ladders, garden furniture, special tables, shelves, deck chairs and lounge beds.

The Preferred Embodiment

Both plate members and distance members are made from plastic for use in connection with insulation of cavity walls. The distance members are made sectionally continuous with a pre-deformed structure having meander configuration as shown in FIGS. 10–12 in the drawing. The width of the distance member band here is 16 mm, which also corresponds to the distance between the displacement surfaces of the individual distance members. The width of the plate members is 2 cm (FIG. 5), and the thickness of the entire space element in the collapsed form is 2–2.5 mm. Completely expanded (FIG. 11) the thickness is 18 mm and is distributed in endless lengths. The cross section defined by the material 11 and the plate members 12 and 13 is a honeycomb.

A somewhat larger space element with a thickness of 10–40 cm, typically 20 cm, is used horizontally in the roof construction over cavity walls of this design.

What is claimed is:

1. An assembly which provides ventilation comprising:

a planar element;

insulation positioned proximate to the planar element; and at least one space element, each space element being positioned between the planar element and the insulation, the space element including two parallel straight plate members and at least one distance member which interconnects the two parallel straight plate members which respectively face the planar element and the insulation, each distance member including two spaced apart bendable sections attached to zones of attachment to the plate members and a displacement part connected to the bendable sections and defining an angle ($\alpha$) with one plate member with the angle ($\alpha$) being variable by parallel displacement of the plate members away from or towards each other and defining a separation which is fixable between the parallel straight plate members with a fixed separation defining a ventilation space between the planar element and the insulation.

2. An assembly in accordance with claim 1 wherein the at least one distance member comprises:

a single continuous distance member having a plurality of connected straight sections with adjacent pairs of straight sections forming the angle ($\alpha$) with a plurality of the sections being parallel to each of the two parallel straight members.

3. An assembly in accordance with claim 1 wherein the at least one distance member comprises:

a plurality of distance members with each distance member being spaced apart from other distance members.

4. An assembly in accordance with claim 1 wherein the at least one distance member comprises:

a single continuous member having a plurality of connected sections which form a honeycomb like structure between the two parallel straight members.

5. An assembly in accordance with claim 1 further comprising:

at least one connection element which fixes the two parallel straight members together to fix the separation between the two parallel straight members.

6. An assembly in accordance with claim 5 wherein the at least one connection element comprises:

a staple.

7. An assembly in accordance with claim 2 further comprising:

at least one connection element which fixes the two parallel straight members together to fix the separation between the two parallel straight members.

8. An assembly in accordance with claim 7 wherein the at least one connection element comprises:

a staple.

9. An assembly in accordance with claim 8 further comprising:

at least one connection element which fixes the two parallel straight members together to fix the separation between the two parallel straight members.

10. An assembly in accordance with claim 9 wherein the at least one connection element comprises:

a staple.

11. An assembly in accordance with claim 4 further comprising:

at least one connection element which fixes the two parallel straight members together to fix the separation between the two parallel straight members.

12. An assembly in accordance with claim 11 wherein the at least one connection element comprises:

a staple.

13. An assembly in accordance with claim 2 wherein the angle $\alpha$ is 90°.

14. An assembly in accordance with claim 7 wherein the angle $\alpha$ is 90°.

* * * * *